US007965973B2

(12) United States Patent
Kawamoto

(10) Patent No.: US 7,965,973 B2
(45) Date of Patent: Jun. 21, 2011

(54) IMAGE FORMING APPARATUS WITH DEHUMIDIFYING HEATER

(75) Inventor: Motoji Kawamoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 356 days.

(21) Appl. No.: 12/168,735

(22) Filed: Jul. 7, 2008

(65) Prior Publication Data

US 2009/0052961 A1 Feb. 26, 2009

(30) Foreign Application Priority Data

Aug. 24, 2007 (JP) ..... 2007-218179

(51) Int. Cl.
*G03G 21/12* (2006.01)

(52) U.S. Cl. ..... 399/360

(58) Field of Classification Search ..... 399/360, 399/123, 94
See application file for complete search history.

(56) References Cited

U.S. PATENT DOCUMENTS

| | | | | |
|---|---|---|---|---|
| 4,891,678 | A | 1/1990 | Ishizu et al. | |
| 5,581,342 | A * | 12/1996 | Yamauchi | 399/123 |
| 2008/0025751 | A1 * | 1/2008 | Andoh et al. | 399/94 |

FOREIGN PATENT DOCUMENTS

| | | | |
|---|---|---|---|
| JP | 5-61385 | A | 3/1993 |
| JP | 5-297773 | A | 11/1993 |
| JP | 6-83129 | A | 3/1994 |
| JP | 11-255361 | A | 9/1999 |

OTHER PUBLICATIONS

European Search Report dated Dec. 5, 2008 for Application No. 08159567.0-2209.

* cited by examiner

*Primary Examiner* — Quana M Grainger
(74) *Attorney, Agent, or Firm* — Cantor Colburn LLP

(57) ABSTRACT

An image forming apparatus includes an image carrying member; an image forming section to form a toner image on the image carrying member; a transferring section to transfer the toner image formed on the image carrying member to a sheet; a fixing section to fix the toner image onto the sheet; a sheet feeding section to feed a sheet to the transferring section; a sheet tray to store sheets to be fed by the sheet feeding section; a dehumidifying heater arranged to the sheet tray and to perform dehumidification for sheets; a waste toner box arranged to adjoin the sheet tray and to accommodate waste toner; and a partition member arranged between the sheet tray and the waste toner box and between the dehumidifying heater and the waste toner box.

7 Claims, 3 Drawing Sheets

IMAGE FORMING APPARATUS WITH DEHUMIDIFYING HEATER

This application is based on Japanese Patent Application No. 2007-218179 filed on Aug. 24, 2007 in Japanese Patent Office, the entire content of which is hereby incorporated by reference.

BACKGROUND OF THE INVENTION

The present invention relates to an image forming apparatus, such as a copying machine, a printer, and a facsimile, in particular to a waste toner box and a sheet tray in detail.

Conventionally, in the image forming apparatus which has a series of electronic photograph processes, toner remaining on an image carrying member is removed by a cleaning member, such as a cleaning blade, and is accommodated in a waste toner box provided under the cleaning member. Moreover, in order to reduce a dead space in an apparatus and to make a maintenance work easy, it has been well known to structure the apparatus such that a waste toner box is arranged to adjoin beside a sheet tray accommodating section, and the sheet tray and the waste toner box are attached or detached from the same direction.

In the above-mentioned structures, at the time of attaching or detaching the above-mentioned waste toner box, when a discharging port of a conveying passage to convey waste toner from the cleaning member to the waste toner box is separated from a joint port of the waste toner box, there has been problems that waste toner scatters from the discharging port and the joint port and pollutes the circumference.

For the above-mentioned problem, there has been disclosed an apparatus in which a waste toner box is arranged at a side of a sheet tray accommodating section provided under the main body of the apparatus so as to accommodate the sheet tray and a joint section between a waste toner conveying means and a relay duct is displaced from the top of the sheet tray (for example, refer to Patent document 1).

Further, there has been disclosed a waste toner recovery apparatus in which a waste toner box is arranged at a side of a sheet tray accommodating section to accommodate a sheet tray to store sheets and there is provided a forcibly conveying means for forcibly conveying waste toner to the waste toner box. At the time of separating a discharging section from the waste toner box, the forcibly conveying means is rotated reversely so as to draw waste toner into a conveying section and to prevent waste toner from scattering to the circumference.

Patent document 1: Japanese Patent Unexamined Publication No. 5-61385

Patent document 2: Japanese Patent Unexamined Publication No. 5-297773

Patent document 1 prevents waste toner from falling while utilizing an empty space in a sheet tray accommodating section effectively. However, it is difficult to prevent waste toner from scattering to the circumference and it is not sufficient to prevent dirt of sheets.

In Patent document 2, it is unable to draw waste toner adhering to a discharging port into the conveying section, and it is not sufficient to prevent scattering of waste toner.

As mentioned above, it is unable to say that it is enough to prevent scattering of waste toner, and also it is unable to say that it is enough to prevent dirt of sheets.

Moreover, a dehumidifying heater is provided to a sheet tray in order to dehumidify sheets. In this structure, heat generated by the dehumidifying heater is transferred to a waste toner box and the heat hardens waste toner in the vicinity of the waste toner box. As a result, the hardened waste toner interferes the fluidity of waste toner at the time of waste toner recovery and makes it difficult to recover waste toner.

SUMMARY OF THE INVENTION

The present invention was conceived in view of the above-mentioned situation, and an object of the invention is to provide an image forming apparatus capable of preventing dirt of sheets caused by the scattering of toner and not lowering the fluidity of waste toner with heat of a dehumidifying heater at the time of waste toner recovery.

The above object can be attained the following structures.

An image forming apparatus, comprises:

an image carrying member;

an image forming section to form a toner image on the image carrying member;

a transferring section to transfer the toner image formed on the image carrying member to a sheet;

a fixing section to fix the toner image onto the sheet;

a sheet feeding section to feed a sheet to the transferring section;

a sheet tray to store sheets to be fed by the sheet feeding section;

a dehumidifying heater arranged to the sheet tray and to perform dehumidification for sheets;

a waste toner box arranged to adjoin the sheet tray and to accommodate waste toner; and a partition member arranged between the sheet tray and the waste toner box and between the dehumidifying heater and the waste toner box.

With the above structures, it becomes possible to prevent waste toner scattered from the waste toner box from entering into the sheet tray, whereby the dirt of sheets can be prevented. Moreover, it can be prevented that heat of the dehumidifying heater transfer to the waste toner box, whereby the hardening of waste toner in the vicinity of the waste toner box due to the heat can be prevented. As a result, the fluidity of waste toner to be recovered to the waste toner box can be maintained, and waste toner can be recovered to the waste toner box smoothly without the adhesion of the waste toner onto the conveying passage.

With the above structures, when the above partition member is structured so as to constitute a part of reinforcing members to reinforce a body of the apparatus, the strength for the space to arrange the sheet tray and the waste toner box can be maintained without adding another reinforcing member, thereby saving costs.

With the above structures, that is, when the waste toner box is arranged at the upstream side of the sheet tray in the sheet feeding direction and the partition member is arranged between the waste toner box and the sheet tray and between the dehumidifying heater and the waste toner box, a space for a maintenance work can be secured in the sheet feeding passage, thereby conducting maintenance easily.

EXPLANATION OF SIGNS

| | |
|---|---|
| A | Image forming apparatus |
| SC | Image reading apparatus |
| P | Sheet |
| 5Y, 5M, 5C, 5K, 8 | Cleaning section |
| 6 | Intermediate transfer member |
| 9 | Transferring section |
| 20 | Sheet feeding section |
| 21 | Sheet tray |
| 30 | Fixing device |
| 50 | waste toner box |
| 60 | Partition member |
| P1, P2, P3, P5, P6, P7 | Toner recovery pipe |
| 64 | Dehumidifying heater |

DETAILED DESCRIPTION OF THE PREFERRED EMBODIMENT

An embodiment of an image forming apparatus according to the present invention will be described with reference to drawings. However, the present invention is not limited to the following embodiment.

Figure 1:
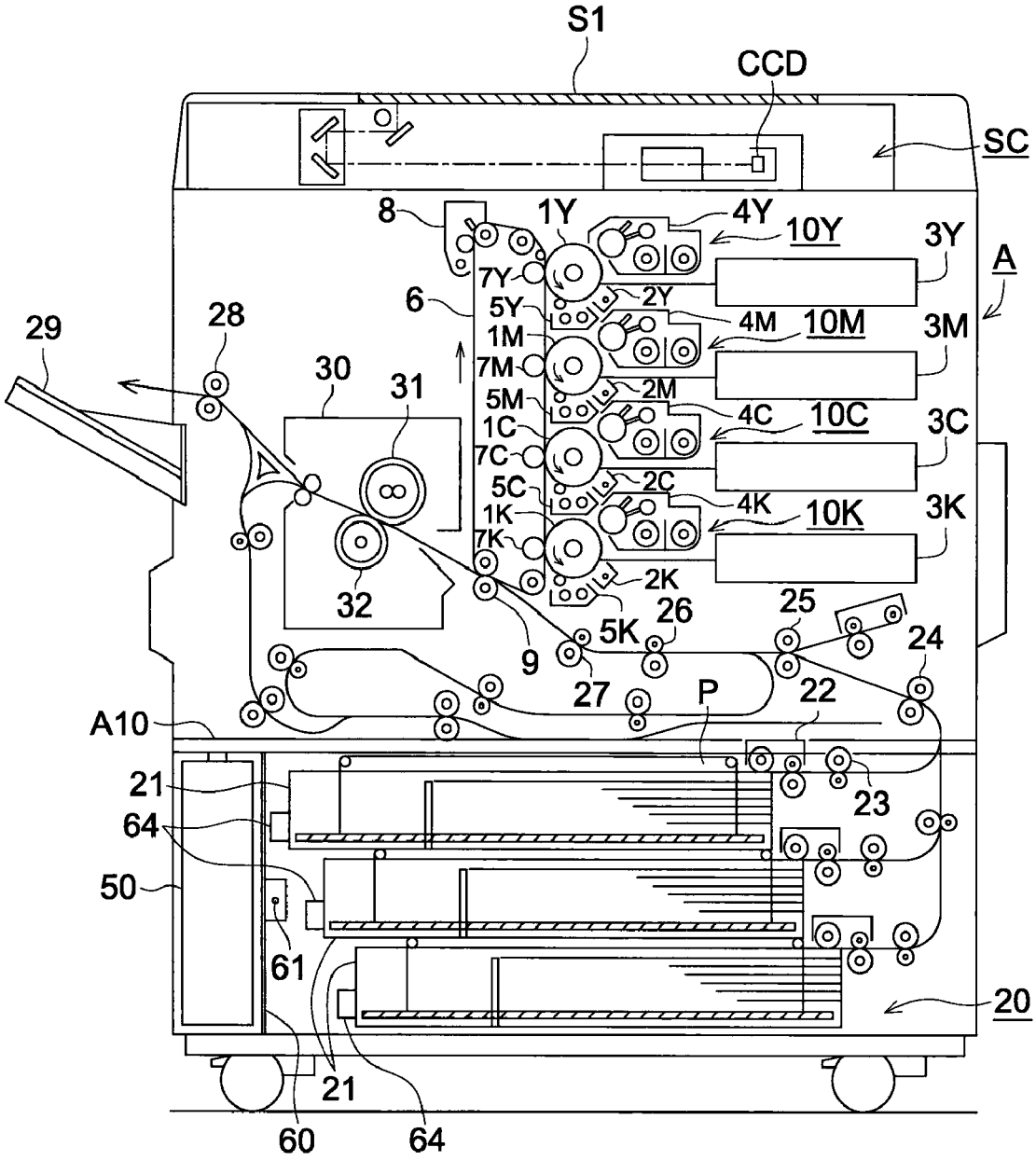
FIG. 1 is a cross-sectional schematic view showing an example of an image forming apparatus according to the present invention.

FIG. 1 is a cross-sectional schematic view showing an example of an image forming apparatus according to the present invention.

The image forming apparatus according to the present invention comprises an apparatus main part A and an image reading apparatus (hereinafter, referred to as scanner) SC. The apparatus main part A is called a tandem type color image forming apparatus and comprises plural sets of image forming sections 10Y, 10M, 10C, and 10K, a belt-like intermediate transfer member 6, a transferring section 9 being a transferring means, a sheet feeding section 20, and a fixing device 30. The sheet feeding section 20 is also used as a sheet tray accommodating section.

A scanner SC is installed in the upper part of the apparatus main part A. An image on a document placed on a document sheet stand S1 of the scanner SC is scanned with exposure by an optical system and is read into a line image sensor CCD.

Image signals are formed through a photoelectric conversion by the line image sensor CCD, subjected to an analog processing, an A/D conversion, a shading compensation, and an image compression processing In an image processing section, and thereafter sent to exposing sections 3Y, 3M, 3C and 3K.

In an image forming section 10Y to form a yellow (Y) color toner image, a charging section 2Y, the exposing section 3Y, a developing device 4Y, and a cleaning section 5Y are arranged around a photoreceptor drum 1Y. In an image forming section 10M to form a magenta (M) color toner image, a charging section 2M, the exposing section 3M, a developing device 4M, and a cleaning section 5M are arranged around a photoreceptor drum 1M. In an image forming section 10C to form a cyan (C) color toner image, a charging section 2C, the exposing section 3C, a developing device 4C, and a cleaning section SC are arranged around a photoreceptor drum 1C. In an image forming section 10K to form a black (K) color toner image, a charging section 2K, the exposing section 3K, a developing device 4K, and a cleaning section 5K are arranged around a photoreceptor drum 1K.

Here, the developing devices 4Y, 4M, 4C, and 4K store two component type developer composed of carrier and small particle size toner of yellow (Y), Magenta (M), cyan (C), and black (K). The toner in this embodiment contains a wax component such as fatty ester, for example, in an amount of 8 to 12 parts by weight and is manufactured by a polymerizing method. However, the toner is not limited to this toner.

The intermediate transfer member 6 is wound around plural rollers, and is supported so as to be rotatable. Respective color component toner images formed by the image forming sections 10Y, 10M, 10C, and 10K are transferred respectively as the first time transfer by the transferring sections 7Y, 7M, 7C, and 7K onto the rotating intermediate transfer member 6. Thereby, the respective color component toner images are superimposed on the intermediate transfer member 6 so as to form a color image on the intermediate transfer member 6.

A sheet P stored in the sheet tray 21 of the sheet feeding section 20 is fed out by a feed roller 22, and conveyed to the transferring section 9 through feed rollers 23, 24, 25 and 26 and a registration roller 27, whereby the color toner image is transferred as the second time transfer onto the sheet P. The sheet trays 21 are supported such that each sheet tray can be pulled out from the front side of the apparatus in FIG. 1. Sheets P can be placed in each of the sheet trays 21 at the position where each of the sheet trays 21 is pulled out from the apparatus.

The fixing device 30 comprises a fixing roller 31 which has an elastic member layer on a metallic core and a built-in heater and a pressing roller 32 which is arranged at a position opposite to the fixing roller and is able to come in pressure contact with the fixing so as to form a fixing nip section. When a sheet P bearing a toner image passes through the fixing nip section in such a way that the toner image surface comes in contact with the fixing roller, the toner image is heated, pressed and fixed onto the sheet P.

After that, the sheet P in which the color toner image was fixed on the sheet P is held between paper ejecting rollers 28 and is delivered and placed on a delivery tray 29 at the outside of the apparatus.

On the other hand, after the color toner image has been transferred from the intermediate transfer member 6 to the sheet by the transferring section 9, residual toner on the intermediate transfer member 6 is removed by the cleaning section 8.

Here, the above embodiment of the image forming apparatus was the image forming apparatus to form a color image. However, it may be also an image forming apparatus to form a monochrome image.

Waste toner removed by the cleaning sections 5Y, 5M, 5C, 5K, and 8 is stored in a waste toner box 50 via a conveyance passage of waste toner.

Figure 2:
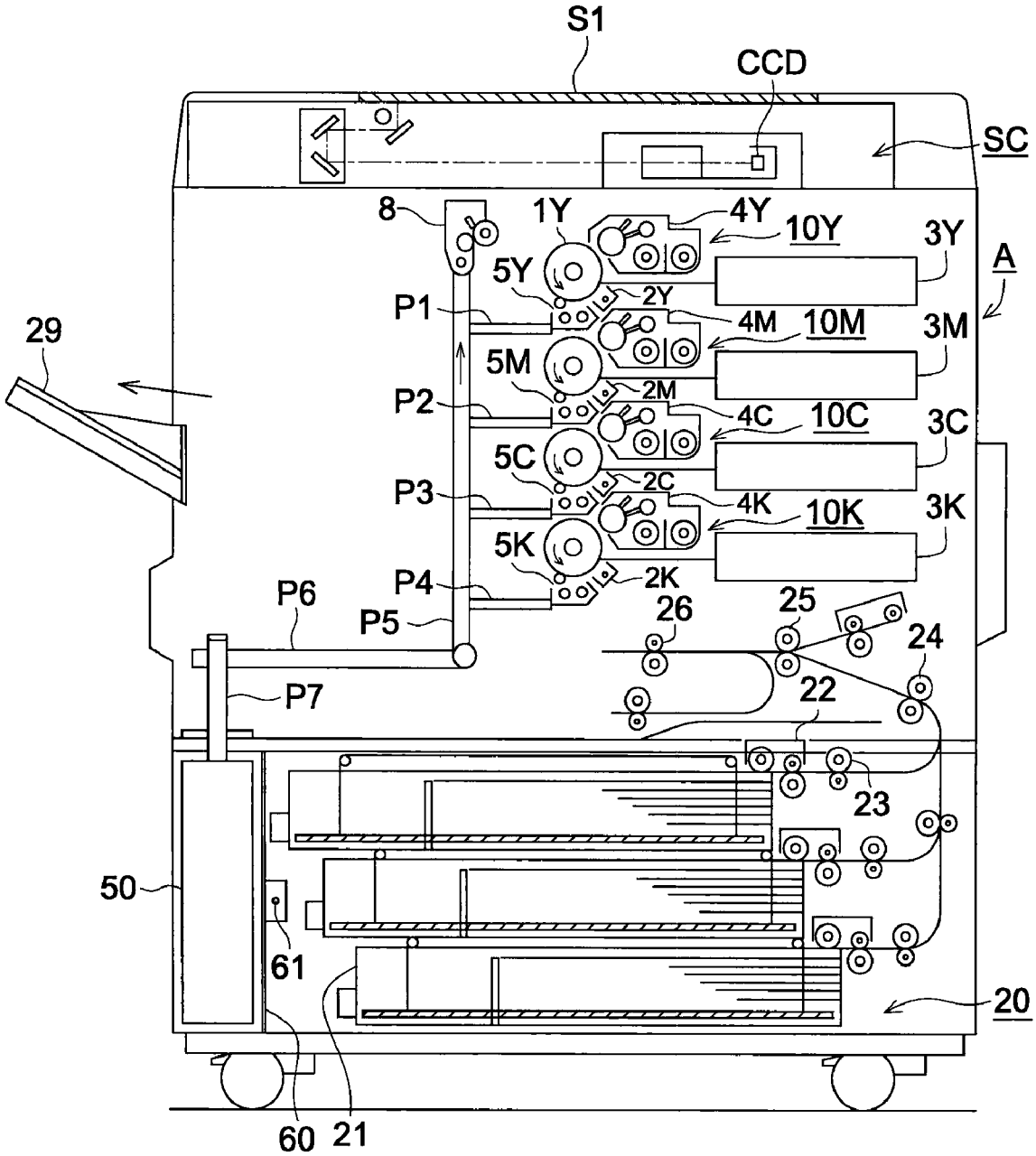
FIG. 2 is a schematic view showing a conveyance passage of waste toner.

FIG. 2 is a schematic view showing a conveyance passage of waste toner. In FIG. 2, the intermediate transfer member 6, the transferring section 9, and the fixing device 30 are omitted for explanation.

Pipes P1 through P7 to convey waste toner and to recover waste toner are arranged near an outer wall of the apparatus main part A. In this embodiment, those pipes are arranged along the outer wall at the rear side in FIG. 2 (in the direction toward to the reverse side of the sheet of FIG. 2). The pipe P1 connects the cleaning section 5Y and the pipe P5. Similarly, pipes P2 to P4 connect the cleaning sections 5M, 5C, and 5K and P5, respectively. The pipe P5 is connected to the pipe P6, and the pipe P6 is connected to the pipe P7, and further the pipe P7 is connected detachably to the waste toner box.

The waste toner recovered by the cleaning section 5Y is conveyed in the direction toward to the rear side in the cleaning section 5Y in FIG. 2 and then conveyed to the pipe P1. The waste toner conveyed to the pipe P1 is conveyed to the pipe P5 by a conveying mechanism (un-illustrated in drawings) provided in the pipe P1. As the conveying mechanism, a conveying mechanism to provide a spiral screw in a pipe P1 for example and to send waste toner into the pipe P5 by rotating the screw with a drive motor may be employed. Similarly, the waste toner recovered by the cleaning sections 5M, 5C, and 5K is also conveyed to the pipe P5.

The waste toner recovered by the cleaning section 8 is conveyed in the direction toward to the rear side (in the direction toward to the reverse side of the sheet of FIG. 2) in the cleaning section 8 and then conveyed to the pipe P5.

The waste toner conveyed to the pipe P5 drops through the inside of the pipe P5, and is conveyed to the pipe P6. It is desirable to provide an adhesion prevention mechanism (unillustrating) to the pipe P5 so that waste toner may not adhere or solidify in the pipe P5 so as not to become obstacle to the dropping of waste toner. As examples of the adhesion prevention mechanism, an adhesion prevention mechanism to provide a rudder-like member in the pipe P5 and to move the rudder-like member up and down in the inside of the pipe P5 with a drive mechanism so as to prevent adhesion may be employed. Moreover, an oscillation may be provided to the pipe 5.

The waste toner conveyed to the pipe P6 is conveyed to the pipe P7 by a conveying mechanism provided in the pipe P6. As the conveying mechanism, a conveying mechanism similar to the conveying mechanism in the pipe 5 may be employed.

The waste toner conveyed to the pipe P7 drops through the inside of a pipe P7, and is accommodated in the waste toner box 50. It is desirable to provide the pipe P7 with a adhesion prevention mechanism similar to the above-mentioned adhesion prevention device provided to the pipe 5. Thereby, the adhesion of waste toner in the pipe P7 can be prevented.

The waste toner box 50 is arranged so as to adjoin the sheet tray 21 at the upstream side in the sheet feeding direction. The waste toner box 50 is installed in such a way that the waste toner box 50 can be detached from the front side of the apparatus in FIG. 1, that is, in the direction to detach the sheet trays 21. With this arrangement, it becomes possible to attach or detach the sheet trays 21 and the waste toner box 50 in the same direction, whereby their operability can be improved. Moreover, since the waste toner box 50 is arranged so as to adjoin the sheet tray 21 at the upstream side in the sheet feeding direction, the space for a maintenance can be secured on a sheet feeding passage at the downstream side in the sheet feeding direction in the sheet trays 21, thereby its maintenance ability for jam of sheets can be improved.

Figure 3:
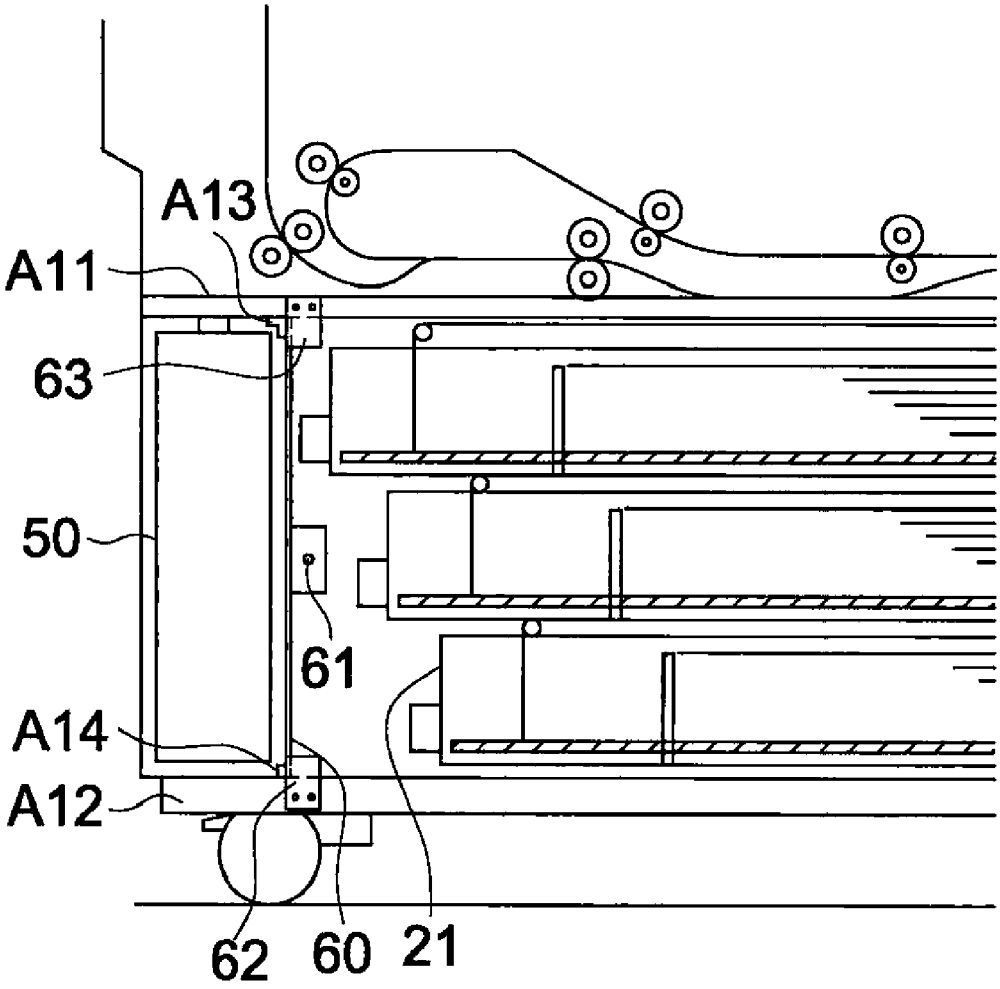
FIG. 3 is a partial view showing a part near a partition member.

The partition member 60 is arranged between the waste toner box 50 and the sheet trays 21. In FIG. 3, A11 and A12 represent a part of a frame of the apparatus main part. FIG. 3 is a segmentary view near the partition member 60. The partition member 60 is guided by a guide member provided in the apparatus, and is positioned in a specified position of the apparatus. In this embodiment, the partition member 60 is guided by a guide member A13 provided in a frame A11, and a guide member A14 provided in a frame A12.

After the partition member 60 is positioned in the specified position, bent sections 61, 62, and 63 of the partition member 60 are fixed to a frame of the apparatus main body with screw. Thereby, the partition member 60 can be constituted as a part of reinforcement members to reinforce the apparatus main body. The guide members, the positions fixed with screws, and so on are not limited to this embodiment, and are suitably determined in accordance with the structure of the apparatus main body, the configuration of the partition member 60, and so on. In the example of FIG. 3, as for the rear side of the partition member 60 (in the direction toward to the reverse side of the sheet of FIG. 3) is fixed by a bent section 63 and the front side (in the direction toward to the front side of the sheet of FIG. 3) is fixed in bent sections 61 and 62.

With this arrangement, even when waste toner scatters at the side of the waste toner box 50, the partition member 60 shelters such that waste toner does not enter into the sheet tray 21. Moreover, the partition member 60 shelters such that heat of the dehumidifying heater 64 arranged in a sheet tray does not transfer to the side of the waste toner box 50.

A metal, resin, etc. may be used for the partition member 60. However, since the partition member 60 is fixed with screws so as to be constituted as a reinforcement member of the apparatus main body, a metal is used preferably.

By the above, even when waste toner scatters at the side of the waste toner box 50, it can be sheltered such hat waste toner may not enter into the sheet tray 21 side, and the dirt of sheet P can be prevented. Moreover, it can be sheltered such that heat of the dehumidifying heater 64 may not be transferred to the side of the waste toner box, and adhesion of waste toner in the vicinity of the jointing port between the pipe P7 and the waste toner box 50 or in the waste toner box 50 can be prevented.

What is claimed is:

1. An image forming apparatus, comprising:

an image carrying member;

an image forming section to form a toner image on the image carrying member;

a transferring section to transfer the toner image formed on the image carrying member to a sheet;

a fixing section to fix the toner image onto the sheet;

a sheet feeding section to feed a sheet to the transferring section;

a sheet tray to store sheets to be fed by the sheet feeding section;

a dehumidifying heater provided to the sheet tray and to dehumidify the sheets in the sheet tray;

a waste toner box arranged at a position next to the sheet tray and to accommodate waste toner; and a partition member arranged between the sheet tray and the waste toner box and between the dehumidifying heater and the waste toner box.

2. The image forming apparatus described in claim 1, wherein the sheet tray and the waste toner box are inserted in a housing of the apparatus in the same direction and detached from the housing of the apparatus in the same direction.

3. The image forming apparatus described in claim 1, wherein the partition member is a reinforcing member to reinforce a housing of the apparatus.

4. The image forming apparatus described in claim 1, wherein the waste toner box and the partition member are arranged at an upstream side of the sheet tray in the sheet feeding direction.

5. The image forming apparatus described in claim 1, further comprising:

a housing including a top frame, a bottom frame, and a middle frame provided between the top frame and the bottom frame, wherein the partition member is provided to separate a space between the bottom frame and the middle frame into a first space in which the sheet tray and the dehumidification heater are accommodated and a second space in which the waste toner box is accommodated.

6. The image forming apparatus described in claim 5, wherein the partition member is a plate which is sandwiched between the bottom frame and the middle frame in such a way that the plate supports the middle frame.

7. The image forming apparatus described in claim 5, wherein the image carrying member, the image forming section, the transferring section, the fixing device, the sheet feeding section are installed between the middle frame and the top frame.

* * * * *